US005182578A

United States Patent [19]

Goepel et al.

[11] Patent Number: 5,182,578

[45] Date of Patent: Jan. 26, 1993

[54] HEATING MECHANISM FOR WARMING THE INK IN THE WRITE HEAD OF AN INK PRINTER MEANS

[75] Inventors: Ernst Goepel, Germering; Rudolf Schierjott, Munich, both of Fed. Rep. of Germany

[73] Assignee: Mannesmann AG, Fed. Rep. of Germany

[21] Appl. No.: 634,224

[22] PCT Filed: Jun. 29, 1988

[86] PCT No.: PCT/DE88/00392

§ 371 Date: Dec. 28, 1990

§ 102(e) Date: Dec. 28, 1990

[87] PCT Pub. No.: WO90/00115

PCT Pub. Date: Jan. 11, 1990

[51] Int. Cl.[5] ..... B41J 2/05

[52] U.S. Cl. ..... 346/140 R

[58] Field of Search ..... 346/140 R; 219/209, 219/219

[56] References Cited

U.S. PATENT DOCUMENTS 4,275,402 6/1981 Kern ..... 346/140 R

*Primary Examiner*—Benjamin R. Fuller
*Assistant Examiner*—Alrick Bobb
*Attorney, Agent, or Firm*—Hill, Van Santen, Steadman & Simpson

[57] ABSTRACT

In an ink jet printer, the ink is warmed by a heating device comprising a temperature sensor element and a voltage regulator component as a heating element, this being arranged on the write head carrier; the heating element is supplied with a constant load current via a regulating circuit until an adjustable operating temperature is reached; the heating energy for warming the ink is offered via the dissipated heat of the heating element.

3 Claims, 2 Drawing Sheets

HEATING MECHANISM FOR WARMING THE INK IN THE WRITE HEAD OF AN INK PRINTER MEANS

Figure 1:
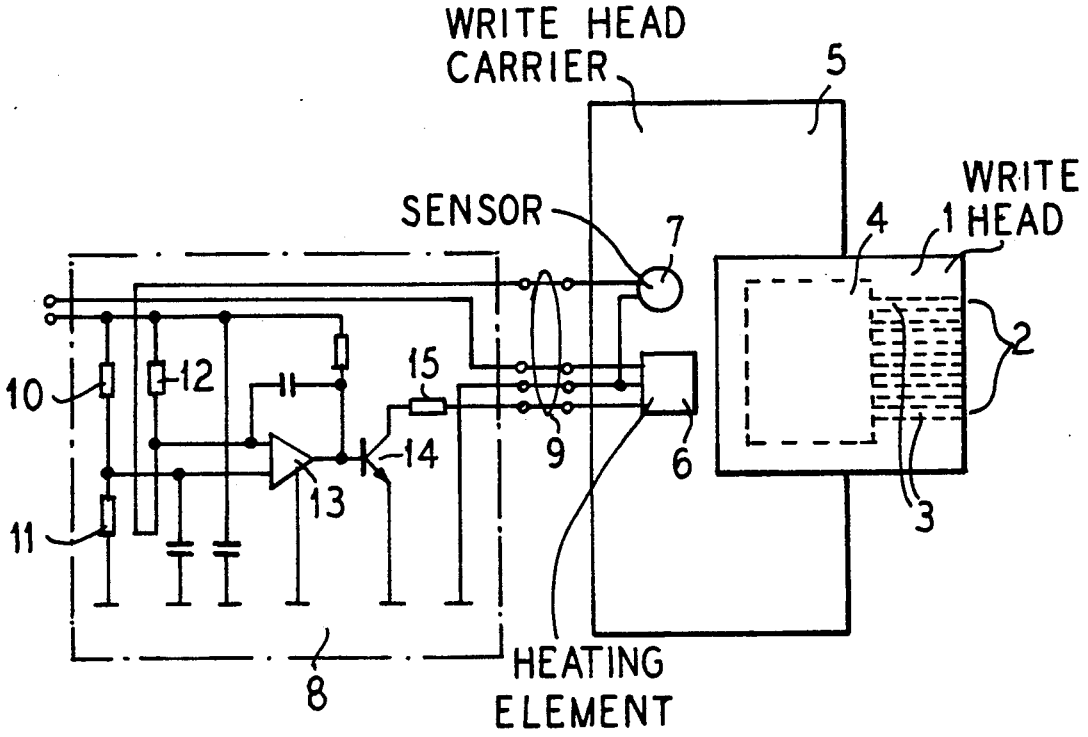

The invention is directed to a heating mechanism for warming the ink in the write head of an ink printer means wherein the wire head comprises a plurality of ink channels ending in discharge openings and comprising individually drivable, electrothermal transducer elements allocated to every ink channel under whose influence the ink in the region of a transducer element in the ink channel is suddenly heated until an ink vapor bubble is formed, and, in particular, whereby the write head is arranged in a write head carrier that is large in area in comparison to the write head.

A known principle for portraying characters on a recording medium is based upon ejecting individual ink droplets from the nozzles of a write head that is a component part of an ink printer means the ink drops, being ejected therefrom under the influence of a control means. Characters and/or graphic patterns are constructed grid-like on the recording medium by coordinating the ejection of individual droplets and the relative motion between the recording medium and the write head. The operational reliability and the quality of the recording are highly dependent on the uniformity of the droplet ejection, i.e. the individual droplets ejected by a drive pulse must have a defined size and must leave the nozzle of the write head with the respectively same speed. The influence of the viscosity of the ink is extremely critical for a uniform droplet ejection. This is highly dependent on the temperature. It is therefore already known to hold the temperature of the ink in an ink printer head a constant value. It is known (in German Published Application 26 59 398 for example) to provide a heating element in the nozzle plate for a write head wherein individual ink channels are provided that end at discharge nozzles of a nozzle plate. It is also known for such write heads to provide an induction coil in the region of the nozzle plate and heat to the nozzle plate by eddy currents and hysteresis losses (in German Published Application 35 00 820) for example.

It has recently been disclosed to achieve the ejection of individual ink droplets in that an ink vapor bubble is produced in the region of an electrothermal energy transducer arranged in the ink channel, this ink vapor bubble ejecting a defined ink volume from the ink channel as a droplet. Such write heads can be constructed using what is referred to as thin-film technology. The temperature dependency cf the viscosity of the ink is also a very critical factor for write heads of this type. It is therefore also known for write heads of this type to improve the ejection conditions by warming the ink fluid. This can occur by additional heating elements acting on the ink from the outside (for example, see German Published Application 29 43 164 and German Published Application 35 45 689). PTC resistors are employed as heating elements for this purpose. The temperature of the ink in the write head can thus be brought to a defined value and held at said defined value in combination with a regulating circuit and with a temperature sensor element for which, for example, a high-temperature conductor or a PTC resistor can be utilized. Particularly in write heads having electrothermal transducers, however, relatively long heating times derive since the heating elements are superficially arranged on a write head carrier that is designed relatively bulky or, respectively, large in area. The reason for this is that measures for cooling must be provided under certain circumstances for write heads with electrothermal transducers because of the warming of the ink occurring during an ongoing printing operation. The write head is usually arranged on an aluminum plate for this purpose that serves as a cooling member. When the ink must be warmed upon turn-on, given operation with few nozzles or after longer-lasting printing mode of the ink printer means, the cooling member must then also always be heated as well.

Although it is already known (in German Published Application 29 43 164), for example, to arrange a heating coil in the interior of the ink space, this involves considerable structural outlay. Over and above this, additional problems arise because of chemical processes that occur between the coil material and the ink fluid.

It is an object of the invention to specify an arrangement for warming or, respectively, for heating the ink for a write head in ink printer equipment comprising a plurality of ink channels ending in discharge openings and comprising individually drivable, electrothermal transducer elements allocated to every ink channel under whose influence the ink in the region of a transducer element in the ink channel is suddenly heated until the formation of an ink vapor bubble, whereby the write head is arranged in a write head carrier that is large in area in comparison to the write head, with which the heating time is reduced, with which a reliable regulation is guaranteed, that also only requires a low space requirement for heating elements and, as needed, sensor elements, and that can also be mounted with low outlay.

This object is achieved by a heating device of the type described above for warming the ink in the write head of an ink printer comprising a voltage regulator serving as a heating element and a temperature sensor element arranged on the write head carrier, the voltage regulator and the temperature sensor element being connected to a regulating circuit; the heating element being supplied with a constant load current via the regulating circuit until an operating temperature is reached; and the dissipated power of the heating element warming the write head carrier and the ink in the write head to an operating temperature.

The heating device is further characterized by the heating element being arranged in a housing having a low heat transmission resistance. In a preferred embodiment, the heating device is used on a printer having a plurality of write heads on the write head carrier, and the heating element and the temperature sensor element are arranged on the write head carrier shared in common by all write heads and are connected to the common regulating circuit.

Figure 2A:
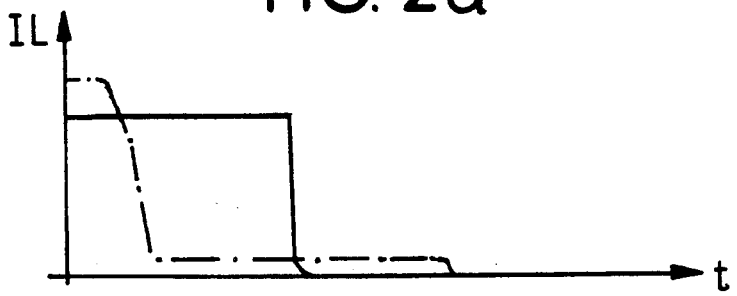
Figure 2B:
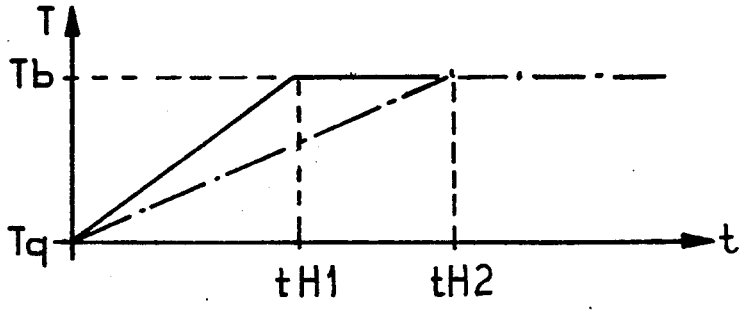
Figure 3:
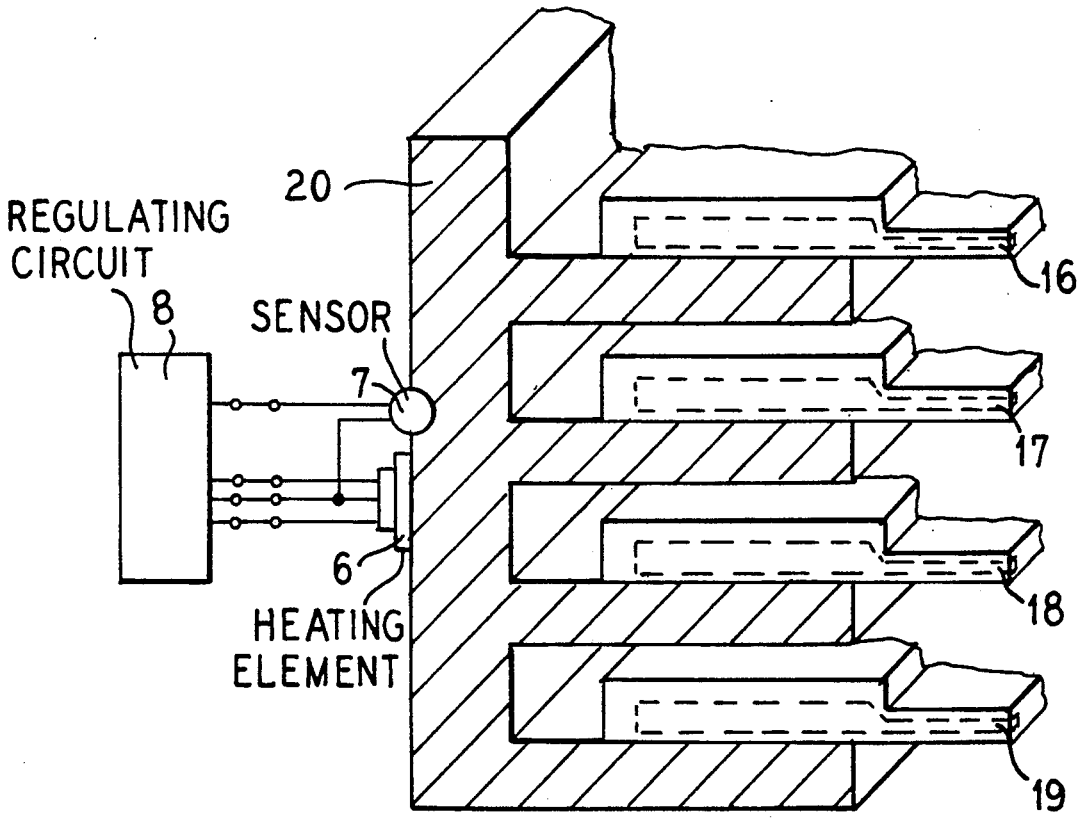

The invention shall be set forth below with reference to the drawings. Shown therein are:

FIG. 1 is a schematic illustration of the arrangement of the heating element inventively employed and of the sensor element on the carrier for the write head together with a regulating circuit;

FIGS. 2*a* and 2*b* are graphs of the curve of the load current of an inventively employed heating element as well as the curve of the temperature dependent on the time;

FIG. 3 is an enlarged cross section of an example of the arrangement of the inventively employed heating element as well as of a sensor element in a printer means comprising a plurality of write heads.

The example illustrated in FIG. I only shows the details necessary for an understanding of the invention, namely a write head 1 with exit nozzles 2 from which individual ink droplets are ejected by individually driven electrothermal transducer elements that respectively act on the ink in the ink channels 3. This is based on the principle that has become notoriously known in the meantime wherein an ink vapor bubble (referred to as a bubble) that effects a droplet ejection arises on the basis of a controlled heating of the electrothermal transducer element in the appertaining ink channel. This principle has therefore become known by the name of the bubble jet method. The individual ink channels 3 are in communication with a common ink chamber 4. Such write heads can be constructed in what is referred to as thin-film technology, whereby the electrothermal transducer, usually a heating resistor, and the contacting for this heating resistor are constructed in layers on a substrate carrier given simultaneously fashioning of the ink chamber 4 and of the ink channels 3.

Corresponding to the demands cited at the outset, in accord wherewith care must be exercised for an adequate cooling during the printing mode given employment of electrothermal transducers as drive elements for the droplet ejection, the write head 1 is arranged on a relatively large-area write head carrier 5 acting as the cooling member. This is usually composed of aluminum.

The heating element 6 provided for warming the ink is arranged on the write head carrier 5, as is the sensor element 7. In accord with the invention, what is a component part of a voltage regulator is employed as their heating element 6 and its dissipated power is exploited for its heating capacity to warm the write head carrier 5. Voltage regulators and their components are intrinsically known. An integrated circuit in which a thermal overload protection that protects the circuit as well as the overall arrangement against destruction or, respectively, burn-up is contained is preferably employed for this purpose. A PTC resistor that is likewise intrinsically known is preferably employed as the sensor element 7. The application of the heating element and of the sensor element on the write head carrier 5 presents no design problems. In cooperation with a regulating circuit 8 that is connected to the heating element 6 and to the sensor element 7 via the terminals 9, noticeably shorter heat-up times for the ink derive than with PTC resistor heating elements of the prior art.

The regulating circuit 8 recited as an example is essentially composed of a first voltage divider having the fixed resistors 10 and 11, of a second voltage divider that contains the sensor element 7 as a further resistor in addition to a fixed resistor 12, of a differential amplifier 13 whose inputs are connected to the taps of the first and of the second voltage divider, as well as of a transistor output stage 14 and of a variable resistor 15 with which the load current IL of the heating element 6 is set. Further component parts (resistors and capacitors) of the regulating circuit 8 are not referenced in detail.

The operation of the arrangement is essentially as follows. Below a defined ink temperature that is referred to below as an operating temperature Tb and that usually amounts to 35° C., the output transistor 14 is transmissive via the output of the differential amplifier 13 and the heating element 6 is thus supplied with the full load current IL. The setting of the current IL and, thus, the setting of the heating energy as well ensues via the resistor 15. In practical operation, a load current IL=0.8 A occurs. The response threshold of the regulating circuit 8 can be set via the resistor 12 in cooperation with the sensor element 7. When the predetermined operating temperature Tb is reached, then the output transistor is turned off via the output of the differential amplifier 13. The dissipated heat arising during the active phase of the voltage regulator component 6 and that is constant during this phase due to the regulator properties of the voltage regulator component 6 leads to a rapid heating of the aluminum carrier 5 and, thus, of the ink in the ink chamber 4 and in the ink channels 3 as well. A heating capacity up to 25 W can be achieved with the voltage regulator serving as the heating element 6. The housing of such a voltage regulator component also has an extremely low heat transmission resistance, this likewise having an extremely beneficial influence on the reduction of the heat-up time.

The advantage involved with the employment of a voltage regulator as the heating element 6 may be seen from FIGS. *2a* and *2b*. The solid line in FIG. *2a* shows the curve of the load current IL and the solid line in FIG. *2b* shows the curve of the temperature T dependent on the time t. For comparison, the current curve and the temperature curve given employment of heating element's of the prior art (PTC resistor), are entered as broken lines in FIGS. *2a* and *2b*. Given employment of a PTC resistor, one can see that a high current first flows upon turn-on (IL=IA) but this drops to a low value FIG. *2a* shortly thereafter when the reference temperature for the PTC resistor is reached. A heat-up time th2 FIG. *2b* thus derives until the operating temperature Tb (for example, Tb=35° C.) is reached proceeding from an initial temperature Ta (for example, Ta=10° C.). Given employment of the heating element of the invention, the load current IL (IL=0.8A) constantly remains at a high value FIG. *2a* until the required operating temperature Tb is reached. The heat-up time is thereby considerably shorter and the operating temperature Tb is already achieved at time thl FIG. *2b*.

The arrangement can be advantageously utilized in ink printer equipment having a plurality of write heads, for example in what are referred to as multi-color printer means. Since the inventively employed heating element can output a high heating capacity and itself has only a low thermal resistance, it can be arranged on the common write head carrier for the write heads together with the sensor element. This has the advantage that a single heating element is adequate for heating the ink of a multitude of write heads and that only a single regulating circuit need be provided as well.

FIG. 3 shows an example of this design. The printer means in this example is composed of four write heads 16 through 19 for which a common write head carrier 20 that can again be an aluminum carrier is provided as cooling member. The heating element 6 and the sensor element 7 are arranged thereon. Differing from the illustration of FIG. 1 wherein an arrangement is shown in plan view, FIG. 3 represents a sectional view, i.e. the ink channels 21 in each of the write heads 16 through 19 lie in the plane of the drawing here. The regulating circuit 8 set forth with reference to FIG. 1 is also utilized, for example, in this embodiment.

Although other modifications and changes may be suggested by those skilled in the art, it is the intention of the inventors to embody within the patent warranted hereon all changes and modifications as reasonably and properly come within the scope of their contribution to the art.

We claim:

1. A write head of an ink printer including a device for warming ink, the write head comprising:

a plurality of ink channels ending in discharge openings in the write head, individually drivable, electrothermal transducer elements as first heating elements allocated to every ink channel under whose influence the ink in a region of a transducer element in the ink channel is suddenly heated until an ink vapor bubble is formed, a write head carrier on which the write head is arranged that is large in area in comparison to the write head, a temperature sensor element mounted on the write head carrier, a regulating circuit means for producing a substantially constant load current to the write head, an additional heating element being a component part of a voltage regulator connected directly across supply leads of the regulating circuit, the additional heating element being an integrated circuit mounted in thermally conductive fashion on the write head carrier together with the temperature sensor element, said integrated circuit being operable at an active phase to regulate voltage across the supply leads and to simultaneously dissipate heat; and means for connecting the additional heating element to receive the constant load current from the regulating circuit means until an operating temperature is reached as a result of dissipated heat of the additional heating element warming the write head carrier and the ink in the write head to the operating temperature.

2. A write head according to claim 1, further comprising:

a housing for the integrated circuit having a low heat transmission resistance and mounted on the write head carrier to transmit heat from said additional heating element to said write head carrier.

3. A write head according to claim 1, wherein said write head comprises a plurality of write heads, the write head carrier being shared in common by all of said plurality of write heads, and said additional heating element and said temperature sensor element are in thermal contact with all of said plurality of write heads.

* * * * *